US009267721B2

(12) United States Patent
Hunter

(10) Patent No.: US 9,267,721 B2
(45) Date of Patent: Feb. 23, 2016

(54) WATER SUPPLY APPARATUS IN REFRIGERATOR

(75) Inventor: Christopher David Hunter, Louisville, KY (US)

(73) Assignee: General Electric Company, Schenectady, NY (US)

( * ) Notice: Subject to any disclaimer, the term of this patent is extended or adjusted under 35 U.S.C. 154(b) by 991 days.

(21) Appl. No.: 12/850,799

(22) Filed: Aug. 5, 2010

(65) Prior Publication Data

US 2012/0031138 A1 Feb. 9, 2012

(51) Int. Cl.

| | |
|---|---|
| ***F25D 25/00*** | (2006.01) |
| ***F25D 23/02*** | (2006.01) |
| ***F25C 1/22*** | (2006.01) |
| *F25D 23/08* | (2006.01) |
| *F25D 23/12* | (2006.01) |

(52) U.S. Cl.

CPC ..... *F25C 1/225* (2013.01); *F25D 23/02* (2013.01); *F25D 23/082* (2013.01); *F25D 23/126* (2013.01); *F25D 2323/024* (2013.01)

(58) Field of Classification Search

CPC ..... F25C 1/225; F25C 2400/14; F25D 2323/024; F25D 23/082; F25D 23/02

USPC ..... 62/377, 137, 74, 344, 449, 340, 347

See application file for complete search history.

(56) References Cited

U.S. PATENT DOCUMENTS

| | | | | | |
|---|---|---|---|---|---|
| 3,775,994 | A * | 12/1973 | Linstromberg | F25D 23/00 | 62/177 |
| 3,866,434 | A * | 2/1975 | Pugh | F25C 1/225 | 62/340 |
| 6,041,607 | A * | 3/2000 | Kim | F25C 1/225 | 137/487.5 |
| 6,148,624 | A * | 11/2000 | Bishop | F25C 5/185 | 62/137 |
| 6,574,982 | B1 * | 6/2003 | Wiseman | F25C 5/005 | 138/33 |
| 6,735,974 | B2 * | 5/2004 | Oh | F25C 1/225 | 239/518 |
| 6,915,644 | B2 * | 7/2005 | Pohl | F25C 1/04 | 62/420 |
| 8,499,577 | B2 * | 8/2013 | Watson | F25C 5/005 | 62/340 |
| 2003/0101741 | A1 * | 6/2003 | Wiseman | F25C 5/005 | 62/347 |
| 2004/0182104 | A1 * | 9/2004 | Choi | F25D 23/028 | 62/389 |
| 2007/0074527 | A1 * | 4/2007 | Lee | F25C 5/005 | 62/344 |
| 2007/0144203 | A1 * | 6/2007 | Kim | F25D 23/02 | 62/389 |
| 2007/0204648 | A1 * | 9/2007 | Smale | F25D 23/126 | 62/389 |
| 2009/0178429 | A1 * | 7/2009 | Lee | F25C 5/005 | 62/344 |
| 2009/0255291 | A1 | 10/2009 | Lee et al. | | |
| 2010/0147008 | A1 * | 6/2010 | Watson | F25C 5/005 | 62/340 |
| 2012/0055190 | A1 * | 3/2012 | Mitchell | F25D 23/126 | 62/389 |
| 2012/0111047 | A1 * | 5/2012 | Van Meter | F25C 5/005 | 62/344 |
| 2013/0068793 | A1 * | 3/2013 | Krause | F25D 23/126 | 222/146.1 |

* cited by examiner

*Primary Examiner* — Cassey D Bauer
*Assistant Examiner* — Martha Tadesse
(74) *Attorney, Agent, or Firm* — Dority & Manning, P.A.

(57) ABSTRACT

A water supply apparatus arranged in a door of a refrigerator, for conveying water to an icemaker of the refrigerator. The apparatus has a water tube for delivering water from a water source, a support block attached to an inner surface of the door, a fill tube assembled to the support block and in fluid communication with the water tube, and a gasket disposed between the support block and the door for sealing an insulator in the door. The gasket has a hole through which the fill tube extends to convey the water from the water tube to the icemaker.

16 Claims, 8 Drawing Sheets

WATER SUPPLY APPARATUS IN REFRIGERATOR

BACKGROUND OF THE INVENTION

The current disclosure relates generally to refrigerators. More specifically, the current disclosure relates to a water supply apparatus used in a refrigerator for conveying water to an icemaker of the refrigerator, a refrigerator door incorporating the water supply apparatus, and a refrigerator incorporating the door.

Generally, a refrigerator includes a freezer compartment and a fresh food compartment, which are partitioned from each other to store various foods at a low temperature in an appropriate state for a long time. It is now common practice in the art of refrigerators to provide an automatic icemaker to speed up the ice-making operation.

In a "bottom freezer" type refrigerator where the freezer compartment is arranged below a top fresh food compartment, convenience necessitates that the icemaker is disposed in the access door of the top mounted fresh food compartment and delivers ice through an opening in the access door of the fresh food compartment, rather than through the access door of the freezer compartment. In this case, a working medium (i.e., coolant), such as air or a mixture of propylene glycol and water, is cooled, directly or indirectly, by the cooling system. The working medium is then delivered through a passageway to the icemaker to maintain the icemaker at a temperature below the freezing point of water. To further improve consumer convenience, the icemaker has been integrated into the fresh food door of the refrigerator, to which end waterline is run through the fresh food door to supply purified water to the icemaker.

Traditionally, the waterline includes a water tube extending upwardly within the fresh food door. The water tube is typically a ¼ inch diameter waterline entering a fill cup disposed above the icemaker and in fluid communication with the icemaker. One disadvantage of the traditional water supply device is that excessive water splash can be created in the fill cup due to the size of the water tube. Another disadvantage of the traditional water supply device is that sweating on the outer surface of the fresh food door and freezing of the waterline adjacent to the icemaker cannot be effectively prevented. The freezing of the waterline can cause ice build-up in the water tube adjacent to the icemaker, which would in turn blocks water flow to the icemaker. Yet another disadvantage of the traditional water supply device is, when an open pour or so-called "clam-shell" foaming process (which will be described later) is used for forming the door, lining up the water supply with the fill cup can be difficult.

Therefore, a water supply device within the fresh food door of a refrigerator, which effectively prevents the occurrence of the above sweating and freezing as well as water splash and overcomes the difficulties in lining up the water supply with the fill cup, is desired.

BRIEF DESCRIPTION OF THE INVENTION

As described herein, the exemplary embodiments of the current invention overcome one or more of the above or other disadvantages known in the art.

One exemplary aspect of the present invention relates to a water supply apparatus disposed in a door of a refrigerator for conveying water to an icemaker of the refrigerator. The door includes an insulator disposed therein. The apparatus includes a water tube configured to deliver water from a water source, a support block attached to an inner surface of the door, a fill tube assembled to the support block and in fluid communication with the water tube, and a gasket disposed between the support block and the door and configured to seal the insulator in the door, the gasket having a hole through which the fill tube extends to convey the water from the water tube to the icemaker.

Another exemplary aspect of the present invention relates to a door for a refrigerator. The door includes an outer case forming an exterior of the door, and an inner case coupled with the outer case to form a backside of the door. The inner case and the outer case together define a space, in which an insulator is filled. The inner case defines a compartment in which an icemaker is provided. The door further includes a water tube extending in the space and configured to deliver water from a water source, a support block attached to an inner surface of the outer case, a fill tube assembled to the support block and connected to the water tube, and a gasket disposed between the support block and the inner case and configured to seal the insulator in the space, the gasket having a hole through which the fill tube extends into the compartment for conveying the water from the water tube to the icemaker.

Still another exemplary aspect of the present invention relates to a refrigerator. The refrigerator includes a fresh food compartment, a freezer compartment separated from the fresh food compartment, an access door for selectively opening and closing the fresh food compartment, and an icemaker disposed within the access door and configured to dispense at least one of ice and chilled water to a user upon stimulus. The access door includes an outer case forming an exterior of the access door and an inner case coupled with the outer case to form a backside of the access door. The inner case and the outer case define a space in which an insulator is filled. The inner case further defines a sub-compartment at the backside of the access door, the icemaker being disposed within the sub-compartment. The access door further includes a water tube extending in the space defined by the inner case and the outer case, and configured to deliver water from a water source. The access door further includes a support block attached to an inner surface of the outer case, a fill tube assembled to the support block and connected to the water tube, and a gasket disposed between the support block and the inner case and configured to seal the insulator in the space. The gasket has a hole through which the fill tube extends into the sub-compartment for conveying the water from the water tube to the icemaker.

These and other aspects and advantages of the current invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

Figure 1:
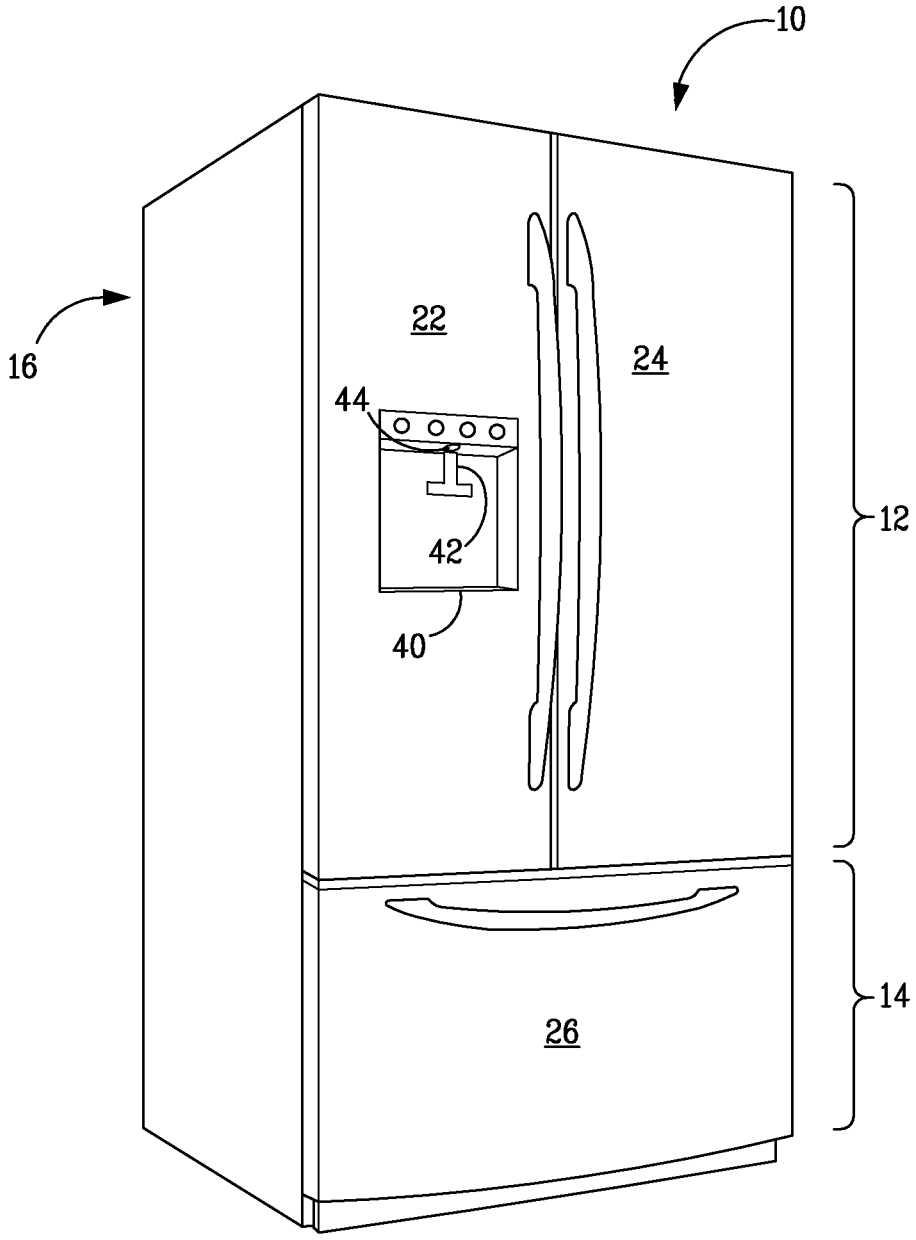
FIG. 1 is a perspective view of a refrigerator in accordance with an exemplary embodiment of the present invention.

FIG. 1 illustrates an exemplary "bottom freezer" refrigerator 10. While the embodiments are described herein in the context of a specific refrigerator, it is contemplated that the embodiments may be practiced in other types of refrigerators. Therefore, as the benefits of the herein described embodiments accrue generally to water conveying and ice dispensing in a refrigerator, the description herein is for exemplary purposes only and is not intended to limit practice of the invention to a particular type of refrigeration appliance or machine, such as the refrigerator 10.

The refrigerator 10 includes a fresh food compartment 12, which can be accessed through one or more access doors for selectively opening and closing the fresh food compartment 12, such as French doors 22 and 24 shown in FIG. 1. However, it should be understood that a single access door can be used instead of the French doors 22 and 24. The refrigerator 10 further includes a freezer compartment 14, which can be accessed through at least one access door, such as a drawer 26.

The refrigerator 10 is contained within a casing 16. The casing 16 is normally formed by folding a sheet of a suitable material, such as pre-painted steel, into an inverted U-shape to form top and sidewalls of the casing 16. A bottom wall of the casing 16 is normally formed separately, and attached to the sidewalls and to a bottom frame that provides support for the refrigerator 10.

Figure 2:
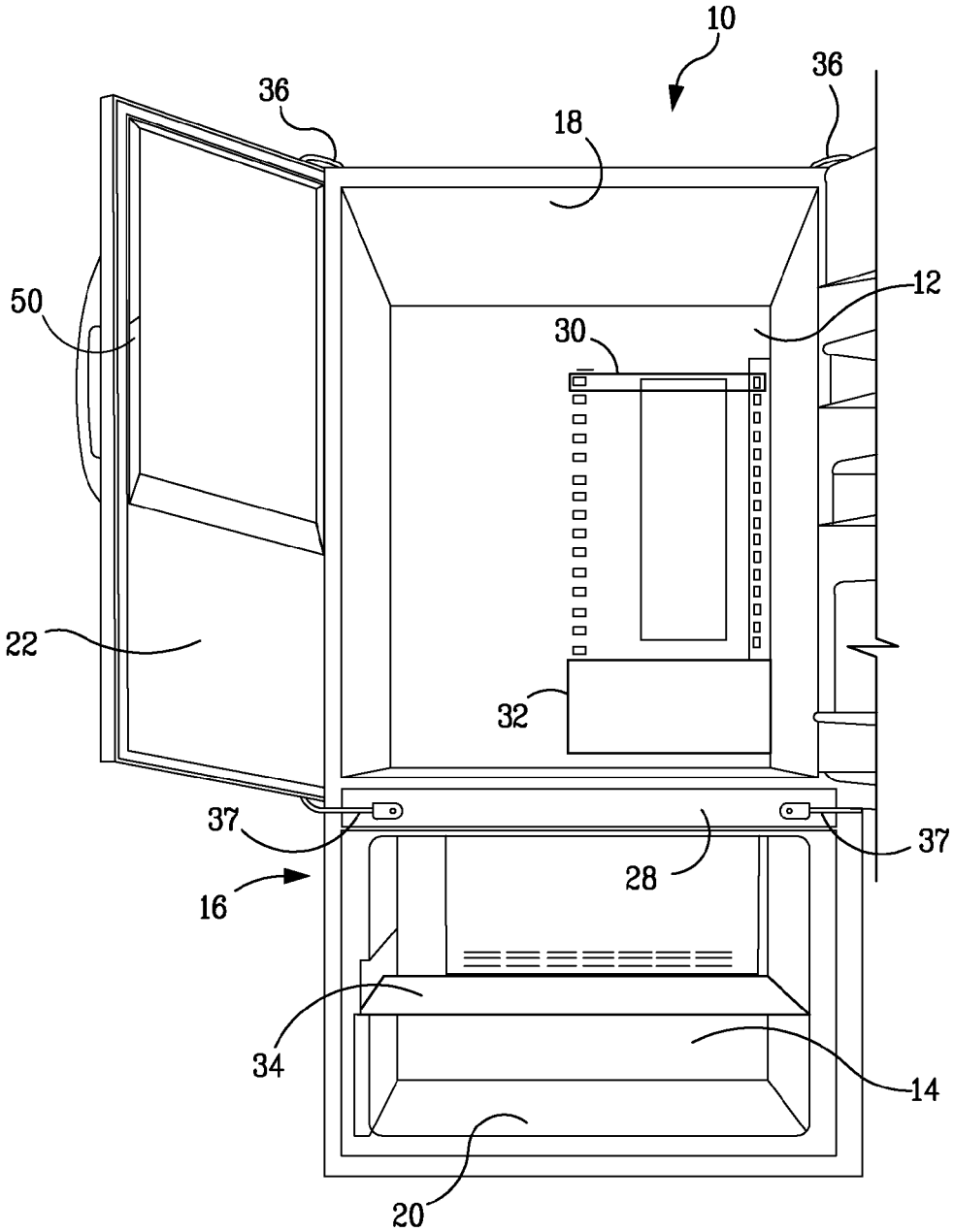
FIG. 2 is a perspective view of the refrigerator of FIG. 1 with the refrigerator doors in an open position and the freezer door removed for clarity.

FIG. 2 illustrates the refrigerator 10 with the French doors 22 and 24 in an open position and the drawer 26 removed. As shown, the fresh food compartment 12 and freezer compartment 14 are arranged in a bottom freezer configuration. The refrigerator 10 further includes inner liners 18 and 20. The inner liners 18 and 20 are molded from a suitable plastic material to form the fresh food compartment 12 and the freezer compartment 14, respectively. Alternatively, the liners 18 and 20 may be formed by bending and welding a sheet of a suitable metal, such as steel. The space between the casing 16 and the liners 18 and 20 as well as the space between the liners 18 and 20 are filled with foamed-in-place insulation. The illustrative embodiment includes two separate liners 18 and 20 as it is a relatively large capacity unit and separate liners add strength and are easier to maintain within manufacturing tolerances.

The insulation in the space between the liners 18 and 20 is covered by another strip of suitable material, which is also commonly referred to as a mullion 28. The mullion 28 in one embodiment is formed of an extruded ABS material. The refrigerator 10 may further include a shelf 30 and slide-out drawer 32, provided in the fresh food compartment 12 to support items being stored therein. A shelf 34 can be further provided in the freezer compartment 14.

In the shown embodiment, each of the French doors 22 and 24 is mounted by a top hinge assembly 36 and a bottom hinge assembly 37 to rotate about its outer vertical edge between a closed position, as shown in FIG. 1, and an open position, as shown in FIG. 2.

Referring back to FIG. 1, on the exterior of the refrigerator 10, there is disposed an external access area 40 to receive ice cubes and/or drinking water. In response to a user's input, such as a stimulus for dispensing water, a water dispenser 42 allows an outflow of drinking water into a user's receptacle. In response to a user's input, such as a stimulus for dispensing ice, an ice dispenser outlet 44 of an ice making, storage and dispensing compartment 50 (shown in FIGS. 2 and 3) allows an outflow of whole ice cubes into a user's receptacle.

As shown in FIG. 2, the ice making, storage and dispensing compartment 50 is defined in the interior of the left French door 22 of the refrigerator 10.

Figure 3:
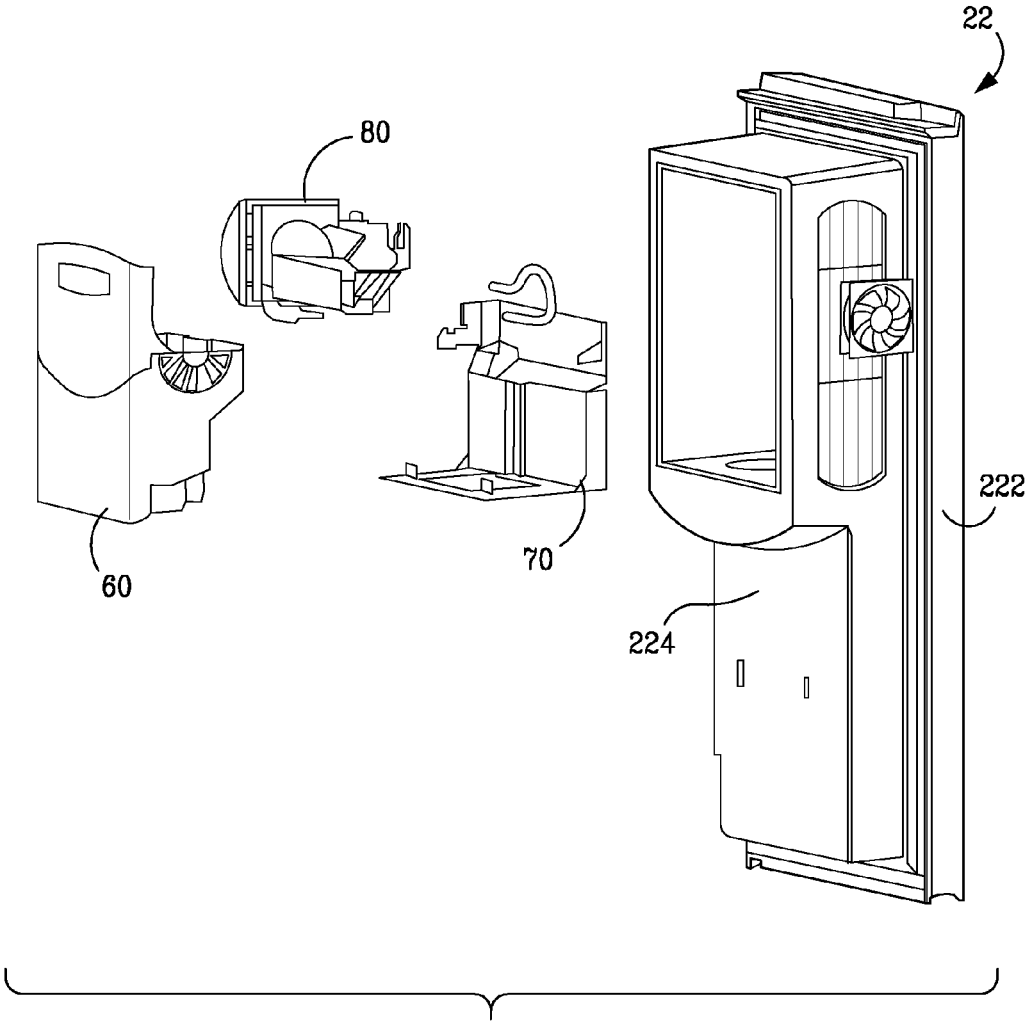
FIG. 3 is a partial exploded view of a door having an icemaker disposed therein, in accordance with an exemplary embodiment of the present invention.

FIG. 3 schematically illustrates an exploded perspective view of the left French door 22 and the ice making, storage and dispensing compartment 50. An ice storage bin 60 and a driving assembly 70 can be assembled into the compartment 50, drivingly engageable with each other. An icemaker 80, such as an electronic icemaker, can be assembled into the compartment 50 and disposed above the ice storage bin 60.

As shown in FIG. 3, the French door 22 includes an outer case 222 forming an exterior of the door 22 and an inner case 224 coupled with the outer case 222 to form a backside of the door 22. Typically, the outer case 222 is made of metal and the inner case 224 is made of plastic materials. A space S (shown in FIG. 5) is defined between the outer case 222 and the inner case 224, in which an insulator 90 (shown in FIG. 5), such as a foaming liquid, can be filled.

For example, for the assembly of the door 22, the outer case 222 and the inner case 224 are integrated through a so-called "clam-shell" design, in which the metal outer case 222 and the plastic inner case 224 are molded together like a clam to define the space S. The ice making, storage and dispensing compartment 50 is defined at the backside of the door 22, by the inner case 224. After the molding of the outer case 222 and the inner case 224, the ice storage bin 60, driving assembly 70 and the icemaker 80 are installed in the ice making, storage and dispensing compartment 50 of the inner case 224. Suitable material for the foaming liquid includes, but is not limited to, polyurethane.

The waterline for supplying cold purified water to the ice maker 80 typically runs through a door hinge (such as the hinge 36 or 37 of the French door 22) and the foaming liquid to convey the water from the metal side of the door to the plastic side of the door.

Figure 4:
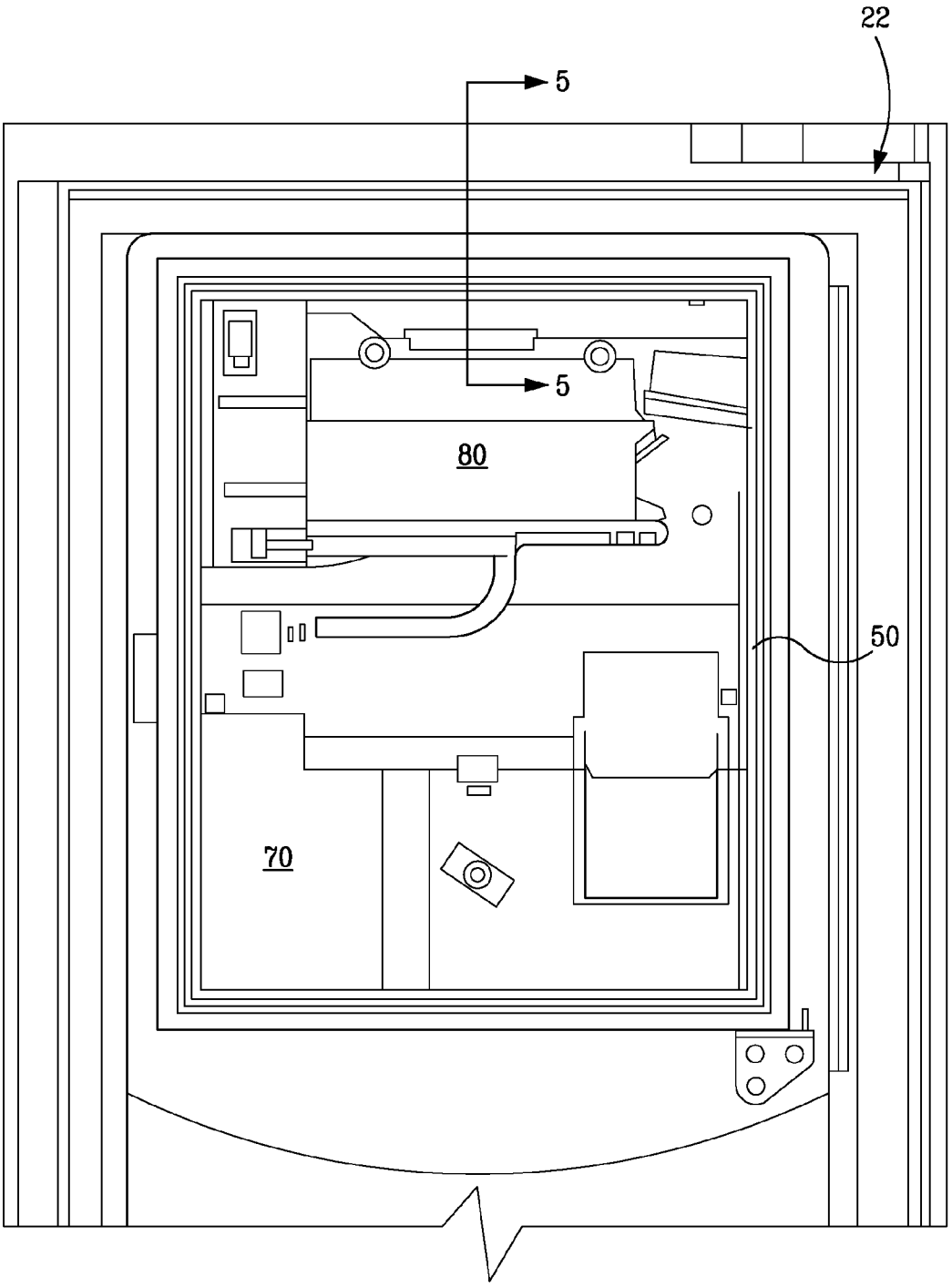
FIG. 4 is a partial elevation view of the door in accordance with an exemplary embodiment of the present invention.
Figure 5:
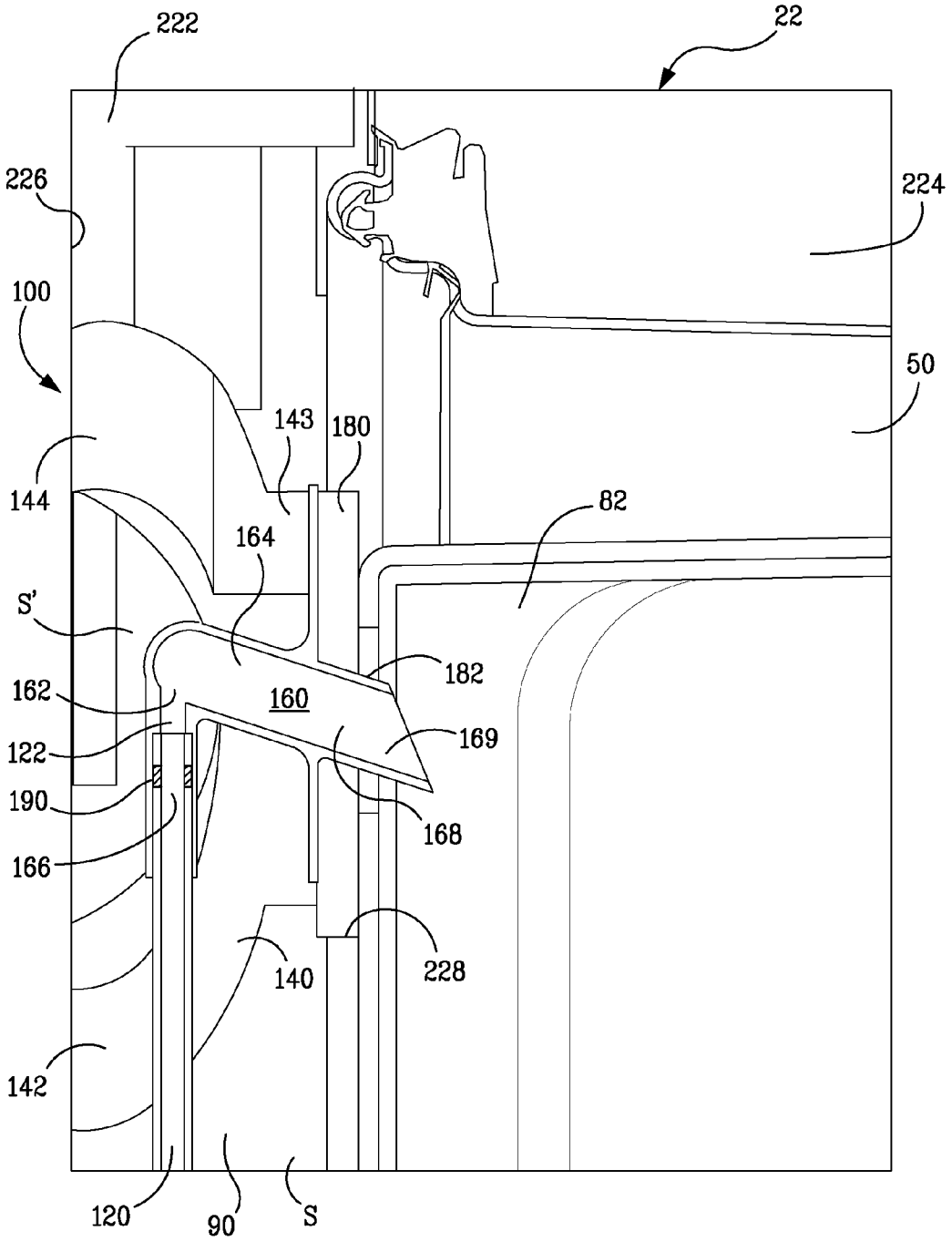
FIG. 5 is a partial cross section view of the door along lines 5-5 of FIG. 4, schematically illustrating a water supply apparatus in accordance with an exemplary embodiment of the present invention, the water supply apparatus being incorporated in the door.
Figure 6:
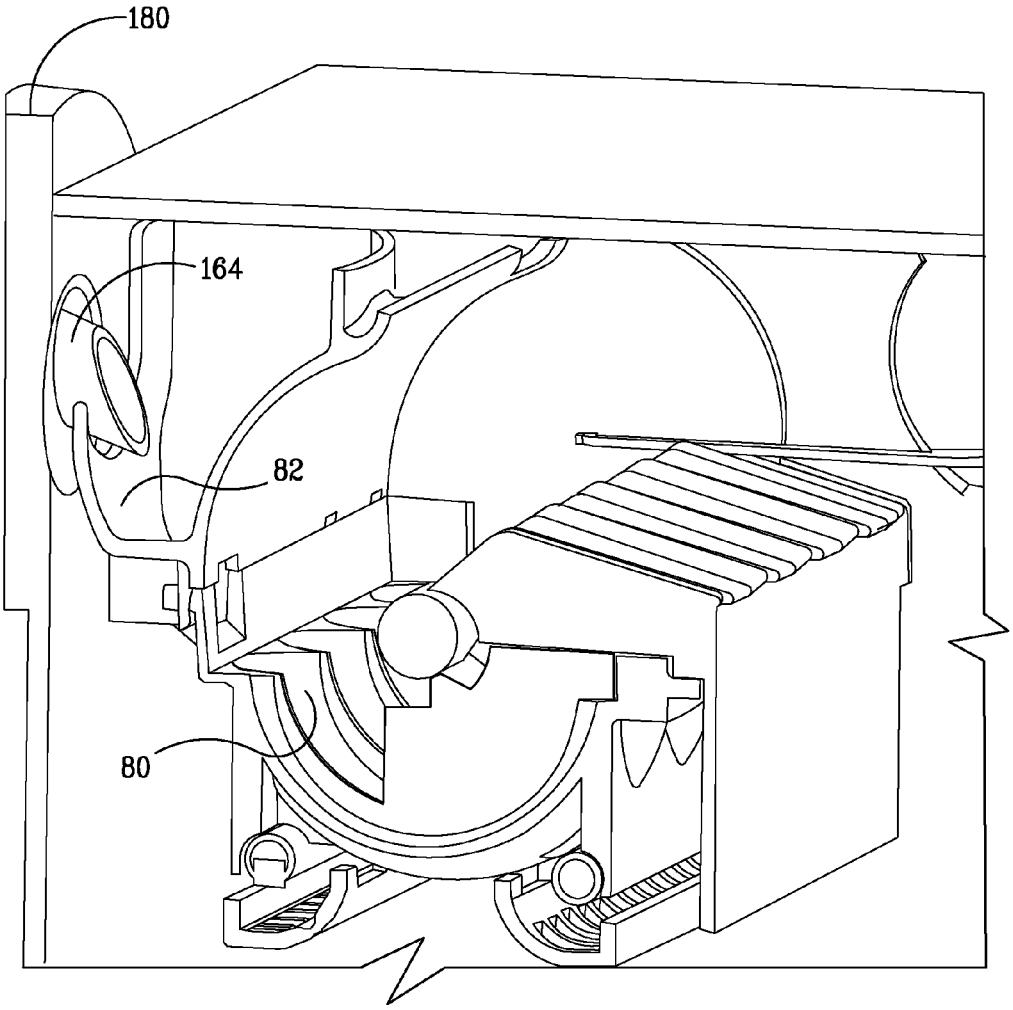
FIG. 6 is a partial perspective view of the door, illustrating the positional relationship between the water supply apparatus and the icemaker.

FIG. 4 is a partial elevation view of the ice making, storage and dispensing compartment 50, with the ice storage bin 60 removed to better depict the inside of the ice making, storage and dispensing compartment 50. FIG. 5 is a partial cross section view of the French door 22 along lines 5-5 of FIG. 4, illustrating a water supply apparatus 100 according to an exemplary embodiment of an aspect of the present invention. FIG. 6 is a partial perspective view of the French door 22, illustrating the positional relationship between the water supply apparatus 100 and the icemaker 80.

As shown, the water supply apparatus 100 is disposed in the space S defined by the outer case 222 and the inner case 224 of the French door 22. The water supply apparatus 100 includes a water tube 120 configured to deliver water from a water source (not shown), a support block 140 attached to an inner surface 226 of the outer case 222, and a fill tube 160 assembled to the support block 140 and in fluid communication with the water tube 120.

In the shown embodiment, the fill tube 160 includes a first tube section 162 and a second tube section 164, connected with each other angularly. The first tube section 162 and the second tube section 164 can have similar or different sizes or diameters. Optionally, the second tube section 164 extends downwardly to form an acute angel with the first tube section 162, so that there is no water accumulation in the second tube section 164, which assists in preventing water freezing in the second tube section 164.

The water tube 120 extends upwardly in the foaming liquid insulator 90, and an upper end 122 of water tube 120 engages a lower end 166 of the first tube section 162 to implement the fluid communication between the water tube 120 and the fill tube 160. The lower end of the water tube 120 is connected to the water supply line (not shown) of the refrigerator 10.

The water supply apparatus 100 further includes a gasket 180, which serves as an interface between the assembly of the support block 140 and the fill tube 160 and the inner case 224 of door 22. For example, the gasket 180 is properly dimensioned and positioned to caulk the gap between the support block 140 and the inner case 224, thereby positively sealing the foaming liquid insulator 90 within the space S between the outer case 222 and the inner case 224. For example, the gasket 180 can be embedded in a recess 228 of the inner case 224 to provide a better sealing effect.

Suitable materials for forming the gasket 180 include, but are not limited to, closed cell polyethylene. The gasket 180 has a hole 182, through which the second tube section 164 of the fill tube 160 extends to convey the water from the water tube 120 to the fill cup 82 above the icemaker 80. Once the second tube section 164 passes through the hole 182, an end 168 of the second tube section 164 is exposed to the fill cup 82 in the compartment 50. The exposed end 168 can be formed to have a slanted terminus 169, which can effectively prevent occurrence of water splashing when the water is conveyed through the fill tube 160.

Figure 7:
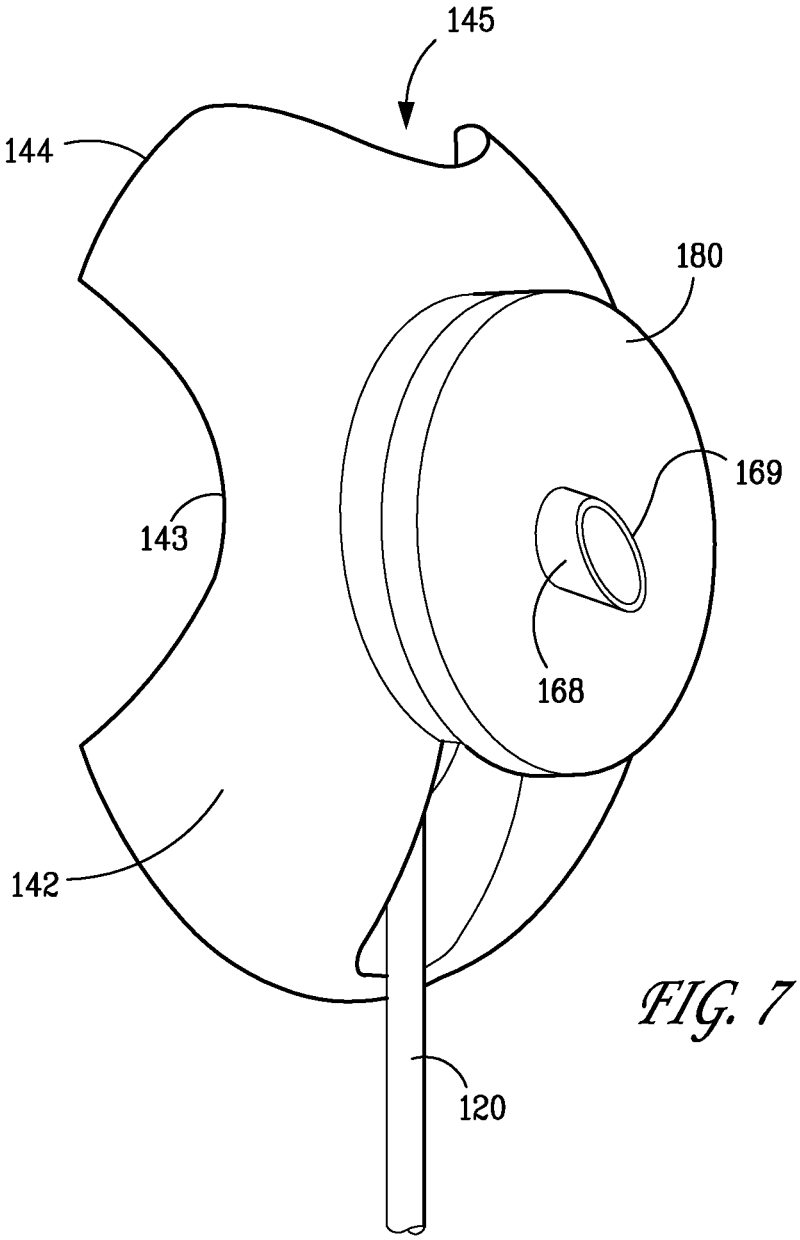
FIG. 7 is a perspective view of the water supply apparatus shown in FIG. 5.
Figure 8:
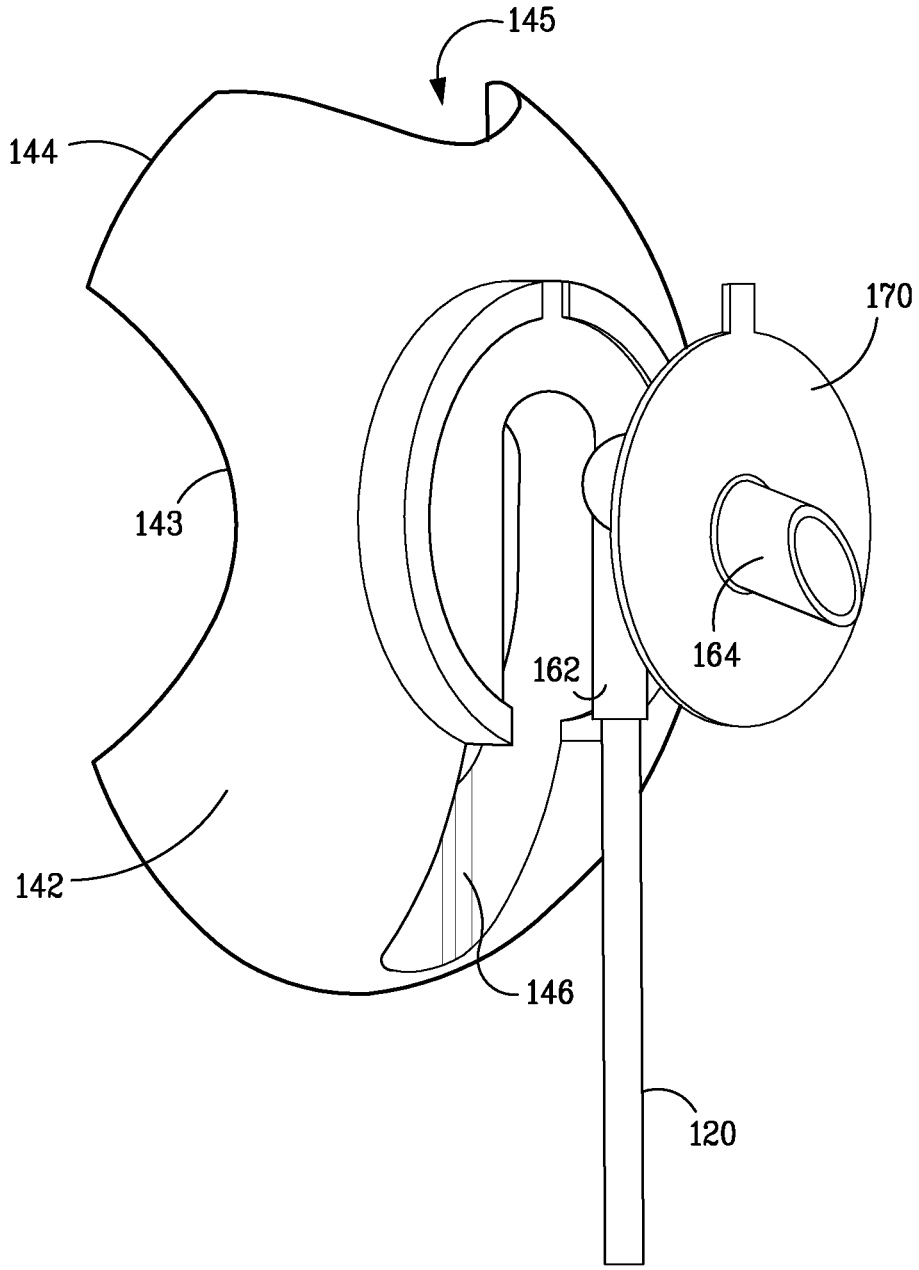
FIG. 8 is an exploded perspective view of the water supply apparatus shown in FIG. 5.

FIG. 7 is a perspective view of the water supply apparatus 100. FIG. 8 is an exploded perspective view of the water supply apparatus 100, with the gasket 180 removed to better depict the support block 140 and the fill tube 160.

As shown, according to an exemplary embodiment, the support block 140 includes a substantially bowl-shaped support body 142 and a base 143 integral with the support body 142. Optionally, the base 143 is substantially round, as shown. However, the base 143 can be of any suitable shape and profile. The edge 144 of the support body 142, distal to the base 143, is attached to the inner surface 226 of the outer case 222. For example, the support block 140 can be integrally molded with the outer case 222 at the edge 144. At least one cutout 145 is provided in the bowl-shaped support body 142 along the edge 144 of the support body 142, for allowing the foaming liquid to enter a substantially bowl-shaped space S' defined by the support body 142. Although two cutouts 145 are shown in FIGS. 7 and 8, a person of ordinary skill in the art understands that the number, size and shape of the cutouts are not limited to what are shown, as long as the foaming liquid can readily flow into the space S' through the cutouts. Suitable materials for forming the support block 140 include, but are not limited to, expanded polystyrene.

The bowl-shaped support body 142 provides a structural support for fixing the fill tube 160 and the water tube 120 with respect to the outer case 222 and the inner case 224, so as to improve the structural integrity of the entire water supply apparatus 100. On the other hand, the bowl-shaped support body 142 allows sufficient foaming liquid to enter the space S' between the support body 142 and the inner surface 226 of the outer case 222, thereby ensuring a satisfactory heat insulation to prevent sweating from happening on the outside of the door 22.

As shown in FIG. 8, the fill tube 160 further includes a flange 170 extending substantially radially from the second tube section 164. Optionally, the flange 170 is substantially in the form of a round disc and substantially complementary to the base 143 of the support body 142. The support block 140 has an opening 146 extending through the support body 142 and the base 143. The opening 146 is configured to allow the fill tube 160 to partially enter the opening 146, until the flange 170 of the fill tube 160 engages the base 143 of the support block 140. After the flange 170 of the fill tube 160 engages the base 143 of the support block 140, the gasket 180 is applied to engage the other side of the flange 170 and close the gap between the flange 170 and the inner case 224, so that the entire water supply apparatus 100 is fixed properly in the door 22. Optionally, the opening 146 can be configured to also allow a portion of the water tube 120, connected to the fill tube 160, to extend in the opening 146.

Referring back to FIG. 5, after the water supply apparatus 100 is mounted in position, water supplied from a water source and a waterline of the refrigerator 10 is delivered through the water tube 120 and subsequently the fill tube 160 into the fill cup 82 in fluid communication with the icemaker 80. Since the temperature of the conveyed water can be much lower than the dew point of the ambient air, sweating on the outside of the outer case 222 may happen. On the other hand, the working temperature in the compartment 50 for the icemaker 80 is much lower than the temperature of the conveyed water. Thus, water freezing may happen in the fill tube 160 (especially the first tube section 162) and the water tube 120 if the compartment 50 and the tubes are close.

The water supply apparatus 100, according to an exemplary embodiment of the present invention, can effectively prevent both the sweating and freezing from happening. As previously discussed, the unique design of the bowl-shaped support body 142 ensures that sufficient foaming liquid be filled in the space S' between the support body 142 and the inner surface 226 of the outer case 222. Considering the foaming liquid has very high insulating properties, sweating on the outside of the door 22 can be effectively prevented from happening.

In addition, the dimensions of the support block 140 and the gasket 180 can be selected to place the fill tube 160 (especially the first tube section 162) and the water tube 120 in an optimal position between the outer case 222 and the inner case 224, so that the distance between the tubes and the outside surface of the outer case 222 will not cause sweating and the distance between the tubes and the compartment 50 will not cause freezing.

Optionally, the water supply apparatus 100 can further includes a heater 190 wrapped around the fill tube 160, for heating the fill tube 160 in a controlled manner to clear any ice build-up in the fill tube 160 and/or defrost the fill tube. The heater 190 can be wrapped around the first tube section 162 or the second tube section 164. Additional heaters can be further provided for the water tube 120.

The fundamental novel features of the invention as applied to various specific embodiments thereof have been shown, described and pointed out, it will also be understood that various omissions, substitutions and changes in the form and details of the devices illustrated and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A water supply apparatus disposed in a door of a refrigerator for conveying water to an icemaker of the refrigerator, the door comprising an insulator disposed therein, the apparatus comprising:

a water tube configured to deliver water from a water source;

a support block attached to an inner surface of the door;

a fill tube assembled to the support block, the fill tube being in fluid communication with the water tube; and a gasket disposed between the support block and the door and configured to seal the insulator in the door, the gasket having a hole through which the fill tube extends to convey the water from the water tube to the icemaker, wherein the support block comprises a support body attached to the inner surface of the door, a base integral with the support body, and at least one cutout, wherein the support body has a substantially bowl-shaped profile to define a substantially howl-shaped space between the support body and the inner surface of the door, and wherein the support block is in direct contact with an inner surface of an outer case of the door, said support block disposed between an inner case and the outer case of the door.

2. The water supply apparatus according to claim 1, wherein the at least one cutout allows the insulator to enter the substantially bowl-shaped space.

3. The water supply apparatus according to claim 1, wherein the fill tube comprises a first tube section and a second tube section connected to each other angularly, the first tube section being in fluid communication with the water tube, the second tube extending through the hole of the gasket to expose an end thereof to the icemaker.

4. The water supply apparatus according to claim 3, wherein the exposed end of the second tube section comprises a slanted terminus.

5. The water supply apparatus according to claim 3, wherein the fill tube further comprises a flange extending radially from the second tube section, the gasket disposed between the flange and the door for sealing the insulator in the door.

6. The water supply apparatus according to claim 5, wherein the support block has an opening extending through the support body and the base, the opening being configured to allow the fill tube to partially enter the opening until the flange of the fill tube engages the base.

7. The water supply apparatus according to claim 1, further comprising a heater wrapped around the fill tube for heating fill tube in a controlled manner, thereby preventing occurrence of water freezing in the fill tube.

8. A door for a refrigerator, comprising:

an outer case forming an exterior of the door;

an inner case coupled with the outer case to form a backside of the door, the inner case and the outer case defining a space in which an insulator is filled, the inner case further defining a compartment at the backside of the door, in which an icemaker is provided;

a water tube extending in the space and configured to deliver water from a water source;

a support block;

a fill tube assembled to the support block and connected to the water tube; and a gasket disposed between the support block and the inner case and configured to seal the insulator in the space, the gasket having a hole through which the fill tube extends into the compartment for conveying the water from the water tube to the icemaker, wherein the support block comprises a support body attached to an inner surface of the door, a base integral with the support body, and at least one cutout, wherein the support body has a substantially bowl-shaped profile to define a substantially bowl-shaped space between the support body and the inner surface of the door, and wherein the support block is in direct contact with an inner surface of the outer case of the door, said support block disposed between the inner case and the outer case of the door.

9. The door according to claim 8, wherein the at least one cutout allows the insulator to enter the substantially bowl-shaped space.

10. The door according to claim 8, wherein the fill tube comprises a first tube section and a second tube section connected to each other angularly, the first tube section being connected to the water tube, the second tube extending through the hole of the gasket to expose an end thereof to the icemaker.

11. The door according to claim 10, wherein the exposed end of the second tube section comprises a slanted terminus.

12. The door according to claim 11, wherein the fill tube further comprises a flange extending radially from the second tube section, the gasket disposed between the flange and the door for sealing the insulator in the door.

13. The door according to claim 12, wherein the support block has an opening extending through the support body and the base, the opening being configured to allow the fill tube to partially enter the opening until the flange of the fill tube engages the base.

14. The door according to claim 8, further comprising a heater wrapped around the fill tube for heating fill tube in a controlled manner, thereby preventing occurrence of water freezing in the fill tube.

15. A refrigerator comprising:

a fresh food compartment;

a freezer compartment separated from the fresh food compartment;

an access door for selectively opening and closing the fresh food compartment; and an icemaker disposed within the access door and configured to dispense at least one of ice and chilled water to a user upon stimulus, wherein the access door comprises:

an outer case forming an exterior of the access door, an inner case coupled with the outer case to form a backside of the access door, the inner case and the outer case defining a space in which an insulator is filled, the inner case further defining a sub-compartment at the backside of the access door, the icemaker being disposed within the sub-compartment;

a water tube extending in the space and configured to deliver water from a water source;

a support block;

a fill tube assembled to the support block and connected to the water tube; and a gasket disposed between the support block and the inner case and configured to seal the insulator in the space, the gasket having a hole through which the fill tube extends into the sub-compartment for conveying the water from the water tube to the icemaker, wherein the support block comprises a support body attached to an inner surface of the access door, a base integral with the support body, and at least one cutout, wherein the support body has a substantially bowl-shaped profile to define a substantially bowl-shaped space between the support body and the inner surface of the access door, and wherein the support block is in direct contact with an inner surface of the outer case of the door, said support block disposed between the inner case and the outer case of the door.

16. The refrigerator according to claim 15, further comprising a hinge assembly for mounting the access door to the fresh food compartment, the water tube extending through the hinge assembly to deliver water from a water source.

* * * * *